US009488034B2

(12) United States Patent
Shaw et al.

(10) Patent No.: US 9,488,034 B2
(45) Date of Patent: Nov. 8, 2016

(54) OPENING A CONDUIT CEMENTED IN A WELL

(75) Inventors: Joel David Shaw, Houston, TX (US); Paul Robert Terry, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 352 days.

(21) Appl. No.: 14/006,727

(22) PCT Filed: Apr. 12, 2011

(86) PCT No.: PCT/US2011/032015

§ 371 (c)(1),
(2), (4) Date: Sep. 23, 2013

(87) PCT Pub. No.: WO2012/141685

PCT Pub. Date: Oct. 18, 2012

(65) Prior Publication Data

US 2014/0014362 A1 Jan. 16, 2014

(51) Int. Cl.

| | |
|---|---|
| ***E21B 34/10*** | (2006.01) |
| ***E21B 43/114*** | (2006.01) |
| ***E21B 17/02*** | (2006.01) |
| ***E21B 29/00*** | (2006.01) |
| ***E21B 47/10*** | (2012.01) |
| *E21B 34/00* | (2006.01) |

(52) U.S. Cl.

CPC ..... *E21B 34/10* (2013.01); *E21B 17/023* (2013.01); *E21B 29/00* (2013.01); *E21B 43/114* (2013.01); *E21B 47/10* (2013.01); *E21B 2034/007* (2013.01)

(58) Field of Classification Search

CPC ..... E21B 3/114

See application file for complete search history.

(56) References Cited

U.S. PATENT DOCUMENTS

| | | | | |
|---|---|---|---|---|
| 4,191,250 | A * | 3/1980 | Messenger | E21B 33/0355 166/253.1 |
| 5,467,823 | A * | 11/1995 | Babour | E21B 33/14 166/250.01 |
| 6,994,167 | B2 | 2/2006 | Ramos et al. | |
| 7,637,318 | B2 | 12/2009 | Sierra et al. | |
| 2003/0164037 | A1 * | 9/2003 | Moffatt | E21B 43/11 73/152.46 |
| 2009/0078427 | A1 | 3/2009 | Patel | |

FOREIGN PATENT DOCUMENTS

| | | | |
|---|---|---|---|
| GB | 2387859 | A | 10/2003 |
| WO | WO-03100218 | A1 | 12/2003 |
| WO | WO-2006082364 | A1 | 8/2006 |
| WO | WO-2007115051 | A2 | 10/2007 |
| WO | WO-2008091345 | A1 | 7/2008 |

OTHER PUBLICATIONS

Search Report and Opinion issued by the European Patent Office on Jun. 29, 2015 for European Patent Application No. 11863492.

Canadian Office Action dated Oct. 20, 2014 for Application No. 2,830,927; PCT No. US2011032015.

International Search Report with Written Opinion issued Nov. 14, 2011 for PCT Patent Application No. PCT/US11/032015, 8 pages.

* cited by examiner

*Primary Examiner* — David Andrews
*Assistant Examiner* — Michael Goodwin
(74) *Attorney, Agent, or Firm* — Locke Lord LLP; Peter Fallon; Joshua L. Jones

(57) ABSTRACT

A method of opening a conduit cemented in a subterranean well can include flowing a fluid through a passage in the well after the conduit is cemented in the well, and the conduit opening in response to the flow of the fluid through the passage. A well system can include a flow control device cemented in a wellbore, and a conduit positioned adjacent a passage of the flow control device, whereby the conduit opens in response to the passage being opened.

25 Claims, 5 Drawing Sheets

OPENING A CONDUIT CEMENTED IN A WELL

CROSS-REFERENCE TO RELATED APPLICATION

This application is a national stage under 35 USC 371 of International Application No. PCT/US11/32015 filed on 12 Apr. 2011. The entire disclosure of this prior application is incorporated herein by this reference.

TECHNICAL FIELD

This disclosure relates generally to equipment utilized and operations performed in conjunction with a subterranean well and, in an example described below, more particularly provides for opening a conduit cemented in a well.

BACKGROUND

It is sometimes beneficial to have a well tool cemented in a wellbore. For example, the well tool could be interconnected in a casing or liner string which is cemented in the wellbore. However, if fluid communication with the well tool is later required, the cement can prevent, or at least restrict, such fluid communication.

It will, therefore, be readily appreciated that improvements are needed in the art of establishing fluid communication with a well tool cemented in a well.

SUMMARY

In the disclosure below, methods and systems are provided which bring improvements to the art. One example is described below in which a conduit connected to a well tool is eroded, or otherwise opened, when a flow control device is opened. Another example is described below in which the conduit is itself cemented in a well external to a passage of the flow control device.

In one aspect, a method of opening a conduit cemented in a subterranean well is provided to the art. The method can include flowing a fluid through a passage in the well after the conduit is cemented in the well, and the conduit opening in response to the flow of the fluid through the passage.

In another aspect, a well system is described below. The well system can include a flow control device cemented in a wellbore, and a conduit positioned adjacent a passage of the flow control device. The conduit opens in response to flow through the passage.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
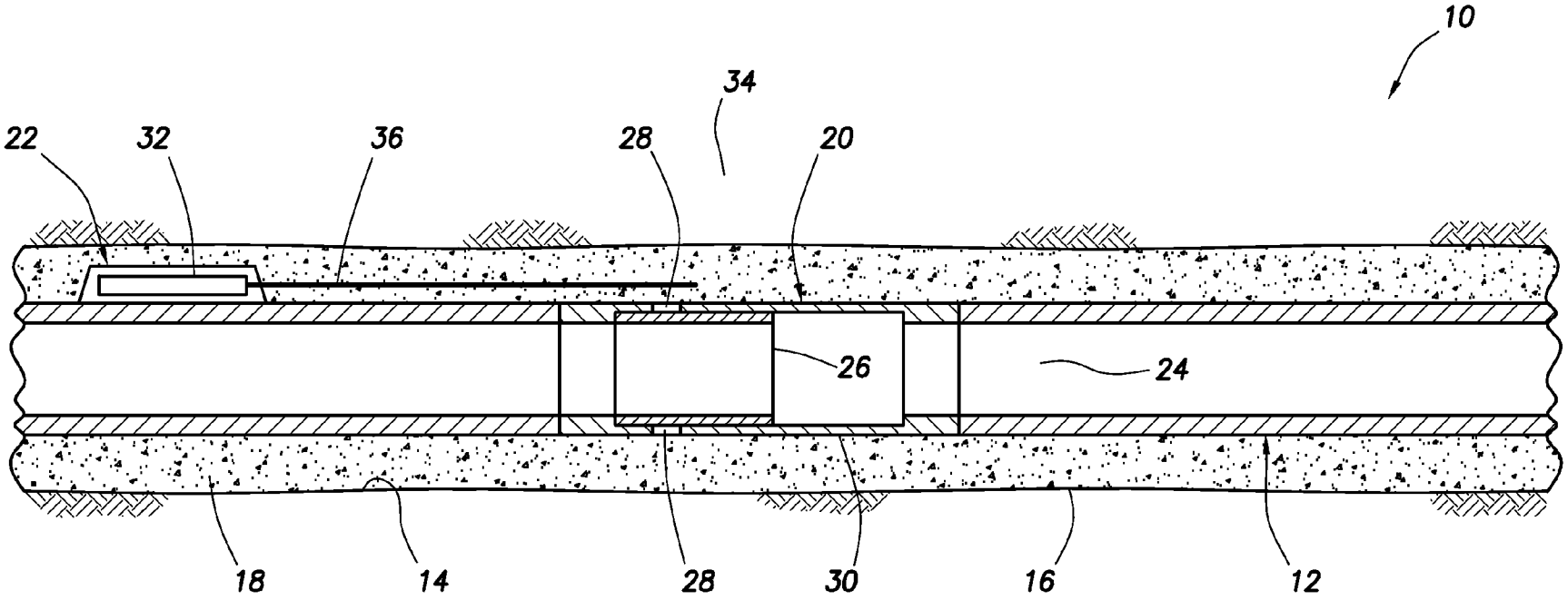
FIG. 1 is a representative partially cross-sectional view of a well system and associated method which can embody principles of this disclosure.

Representatively illustrated in FIG. 1 is a well system 10 and associated method which can embody principles of this disclosure. As depicted in FIG. 1, a tubular string 12 (e.g., a casing, liner or tubing string) is cemented in a wellbore 14, with cement 16 filling an annulus 18 formed radially between the tubular string and the wellbore.

As used herein, the term "cement" is used to describe a hardenable material which is flowed into a well and allowed to harden therein. In the system 10, the cement 16 is used to block flow through the annulus 18, and to stabilize the wellbore 14. Cement is not necessarily cementitious, since other types of materials (e.g., epoxies, other polymers, etc.) may be used also or instead.

Interconnected in the tubular string 12 are a flow control device 20 and a well tool 22. In this example, the flow control device 20 selectively prevents and permits fluid communication between the annulus 18 and an interior flow passage 24 extending longitudinally through the tubular string 12. In other examples, the flow control device 20 could control flow between other portions of the well system 10.

The flow control device 20 could be, for example, a valve, a choke, etc. In FIG. 1, the flow control device 20 is depicted as including a closure member 26 in the form of a sleeve which can be displaced to permit or prevent flow through passages 28 formed in an outer housing 30. In other examples, flow could be permitted or prevented using other types of members or by other means.

The well tool 22 in the system 10 includes a pressure sensor 32 of the type used for long term monitoring of pressure in a well. In this example, it is desired to monitor pressure in an earth formation 34 penetrated by the wellbore 14. However, the cement 16 is disposed about the well tool 22, and between the well tool and the formation 34.

To enable fluid communication between the sensor 32 and the formation 34, a conduit 36 is connected to the sensor and extended to the flow control device 20, so that the conduit is outwardly adjacent one of the passages 28. In this manner, the conduit 36 will be opened when flow is permitted through the adjacent passage 28, for example, due to the flow eroding the conduit, due to the cement 16 cracking adjacent the passage, due to movement of the closure member, etc., as described more fully below.

The conduit 36 may comprise a small tube of the type known to those skilled in the art as a hydraulic control line. However, other types of conduits may be used in keeping with the principles of this disclosure.

After the cement 16 is allowed to harden in the well about the flow control device 20 and well tool 22, the flow control device is opened. Pressure can be applied to the passage 24 (e.g., using a pump at the earth's surface) to force fluid outward through the passages 28 and establish fluid communication between the passage 24 and the formation 34 (for example, by cracking, eroding or dissolving the cement between the passages 28 and the formation).

A suitable flow control device for use in the system 10 is the DELTA STIM SLEEVE™ marketed by Halliburton Energy Services, Inc. of Houston, Tex. USA. Of course, other flow control devices, and other types of flow control devices, may be used in keeping with the principles of this disclosure.

The opening of the flow control device 20 may be performed concurrently with a stimulation operation, for example, to acidize and/or fracture the formation 34. However, it is not necessary for a stimulation operation to be performed in the method.

Note that the well system 10 is described here and depicted in the drawings as merely one example of a wide variety of different well systems in which the principles of this disclosure may be incorporated. For example, it is not necessary for the wellbore 14 to be substantially horizontal as illustrated in FIG. 1, for the tubular string 12 to be an outermost tubular string in the wellbore 14, for the well tool 22 to be connected on any particular side of the flow control device 20, for the well tool and flow control device to be separate portions of the tubular string, for the conduit 36 to be external to the flow control device, for the passages 28 to provide fluid communication between the passage 24 and the annulus 18, etc. Thus, it will be appreciated that the scope of this disclosure is not limited in any manner to the details of the well system 10, flow control device 20, well tool 22, etc., described herein and depicted in the drawings.

Figure 2:
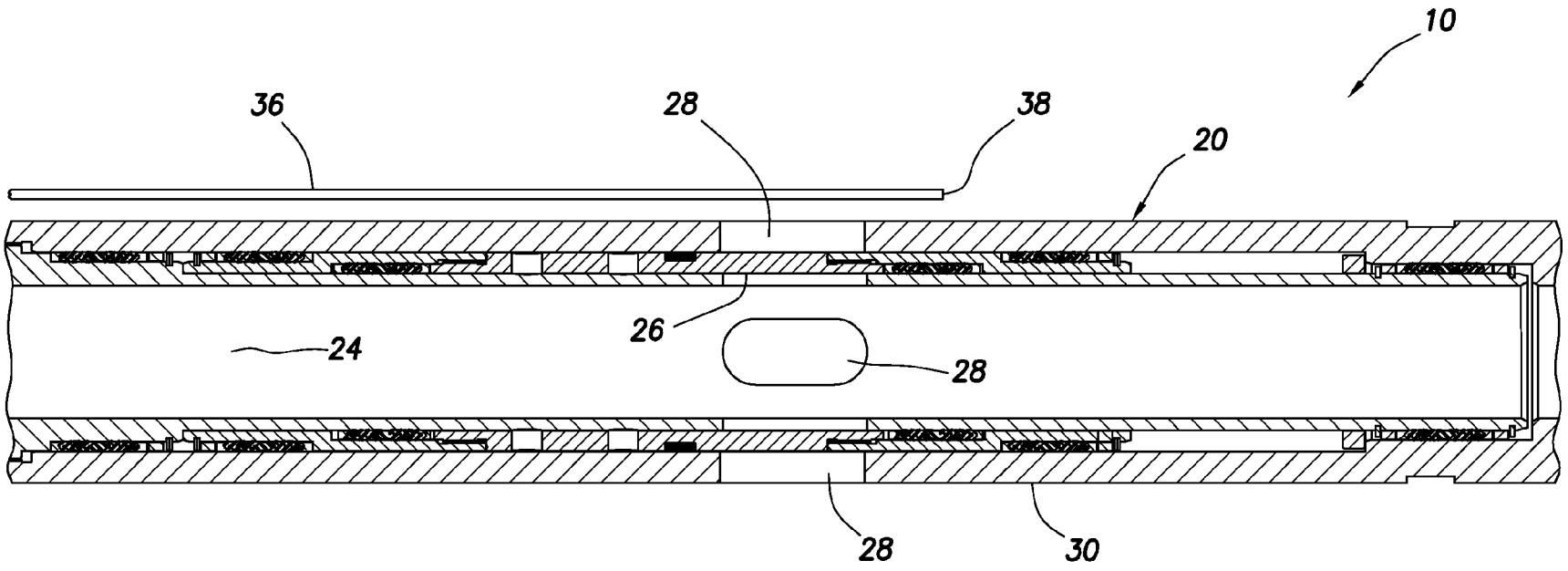
FIG. 2 is a representative cross-sectional view of a flow control device which may be used in the system and method of FIG. 1.

Referring additionally now to FIG. 2, an enlarged scale cross-sectional view of another configuration of the flow control device 20 is representatively illustrated. The flow control device 20 may be used in the well system 10, or it may be used in other well systems in keeping with the scope of this disclosure.

The cement 16 is not shown in FIG. 2 for clarity of illustration. However, it should be understood that, in practice, the cement 16 will preferably at least partially surround the flow control device 20 and conduit 36 in the system 10.

Note that the conduit 36 is positioned closely adjacent to, but spaced apart somewhat from, one of the passages 28. When the closure member 26 is displaced to permit flow through the passages 28, this will cause the conduit 36 to open.

In this example, an end 38 of the conduit 36 is closed off (e.g., plugged), in order to isolate the sensor 32 from the annulus 18 while the tubular string 12 is installed in the well, and while the cement 16 is flowed into the annulus and allowed to harden therein. After the conduit 36 is opened, it will be in fluid communication with the adjacent passage 28, and with the formation 34 via one or more pathways formed by the outward flow of fluid from the passage 28.

The flow control device 20 configuration of FIG. 2 is similar in many respects to an ICV (interval control valve) marketed by Halliburton Energy Services, Inc. The ICV™ variably regulates flow between a formation and a tubular string in the manner of a choke, and can be remotely controlled. However, as mentioned above, any type of flow control device may be used in keeping with the scope of this disclosure.

The flow control device 20 is depicted in a closed configuration in FIG. 2. Displacement of the closure member 26 to the right as viewed in FIG. 2 will open the passages 28 to flow, with such flow being regulated by varying the position of the closure member 26.

Figure 3:
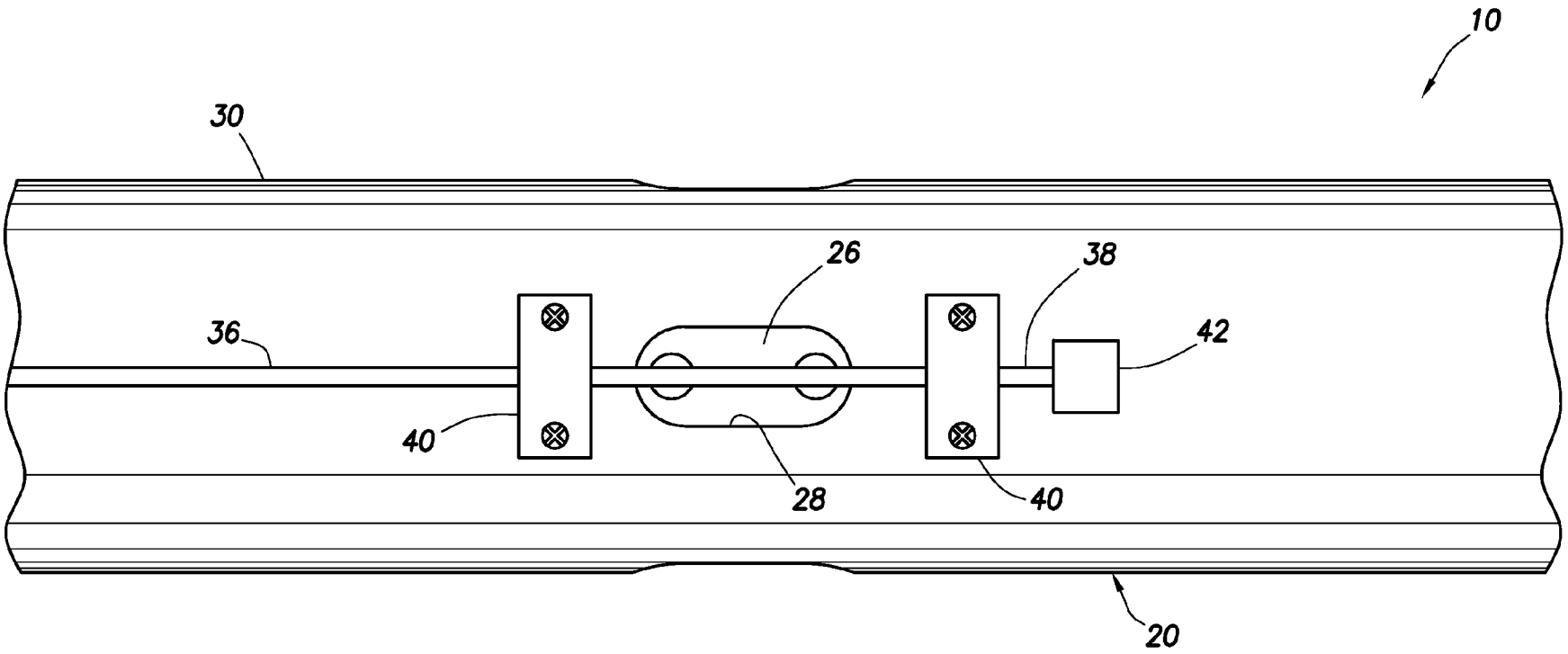
FIG. 3 is a representative top view of the flow control device with a conduit positioned adjacent a passage of the flow control device.

Referring additionally now to FIG. 3, a top view of the flow control device 20 and conduit 36 is representatively illustrated. Again, the cement 16 is not shown in FIG. 3, so that the details of the flow control device 20 and conduit 36 are visible.

In this view it may be seen that the conduit 36 can be attached to an outer surface of the housing 30 using clamps 40 or other attachment devices straddling the passage 28. The conduit 36 extends outwardly across the passage 28.

A plug 42 is depicted in FIG. 3 as being used to close off the end 38 of the conduit 36. In other examples, the end 38 could be closed off by welding, crimping, an internal plug, or by using any other technique.

The closure member 26 is shown in an open position in FIG. 3. In practice, the closure member 26 would be displaced to the open position after the cement 16 has hardened in the annulus 18.

Figure 4:
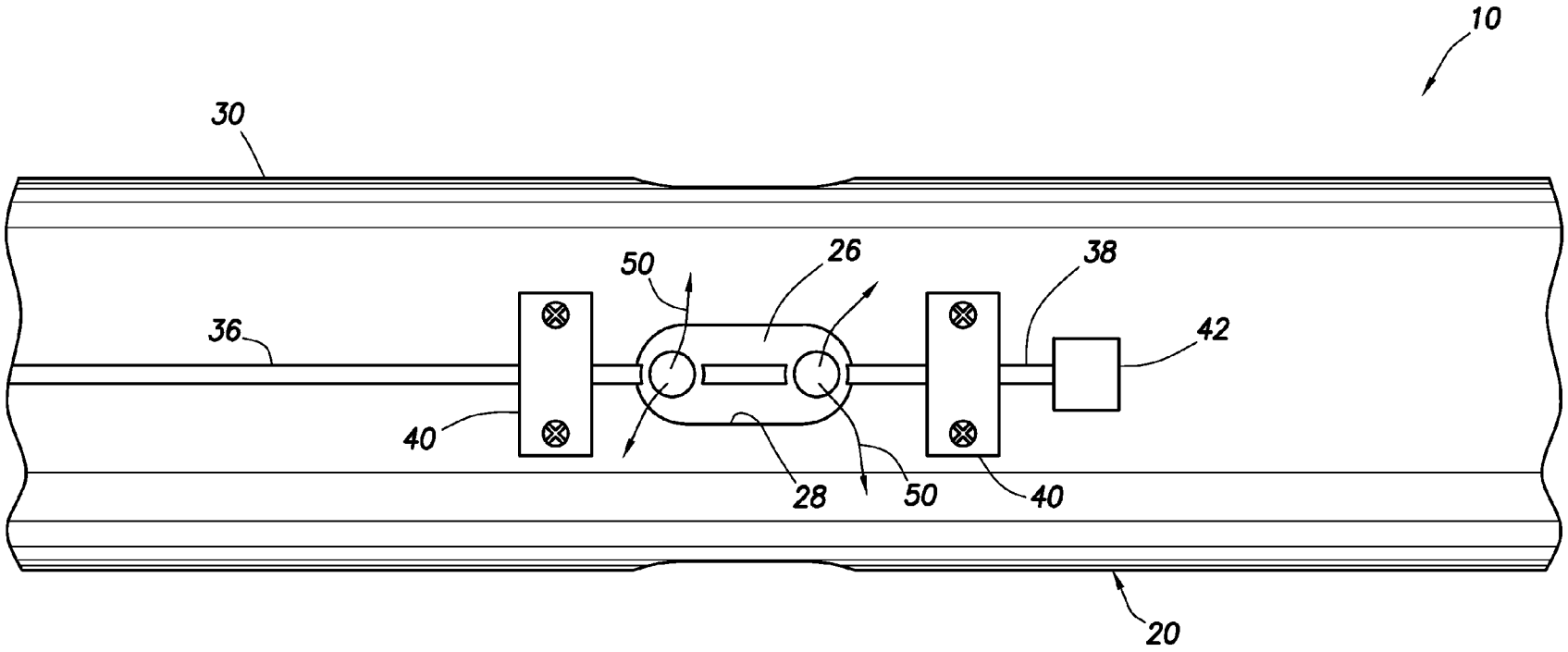
FIG. 4 is a representative top view of the flow control device with the conduit eroded due to flow through the passage.

Referring additionally now to FIG. 4, the flow control device 20 and conduit 36 are again representatively illustrated, without the cement 16 being shown. In this view it may be seen that flow through the passage 28 has eroded the conduit 36, so that the conduit is now open, and is in fluid communication with the passage 28 and the formation 34.

The fluid 50 which flows through the passage 28 could include an abrasive material which quickens the erosion of the conduit 36. For example, in fracturing operations, a slurry pumped through the flow control device 20 would typically include an abrasive proppant.

In other examples, the fluid 50 which flows through the passage 28 could include a substance which degrades the conduit 36. For example, in acidizing operations, acid pumped through the passage 28 could dissolve or otherwise degrade a material of the conduit 36.

In other examples, the conduit 36 could be opened due to cracking of the cement 16 when the fluid 50 is pumped out of the passage 28. For example, the conduit 36 could be made of a frangible material which will break when the cement 16 cracks.

In other examples, the conduit 36 could be opened due to the force of the fluid 50 flowing out of the passage 28. For example, a sufficiently large pressure differential created across the conduit 36 when the passage 28 is opened and fluid 50 is flowed out of the passage could cause the conduit to open.

In other examples, the conduit 36 could be opened by displacement of the closure member 26 to its open position. For example, the plug 42 could be connected to the closure member 26 or another component of the flow control device 20 so that, when the closure member displaces to its open position, the plug no longer prevents flow through the end 38 of the conduit 36.

Thus, it will be appreciated that a large variety of possible ways of opening the conduit 36 in response to flow being permitted through the passage 28 are possible. Accordingly, the scope of this disclosure is not limited at all to the specific ways of opening the conduit 36 described herein and illustrated in the drawings.

Referring additionally now to FIGS. 5-8, various configurations of the conduit 36 are representatively illustrated. These configurations demonstrate that the concepts described herein can be adapted as needed to a variety of different circumstances.

Figure 5:
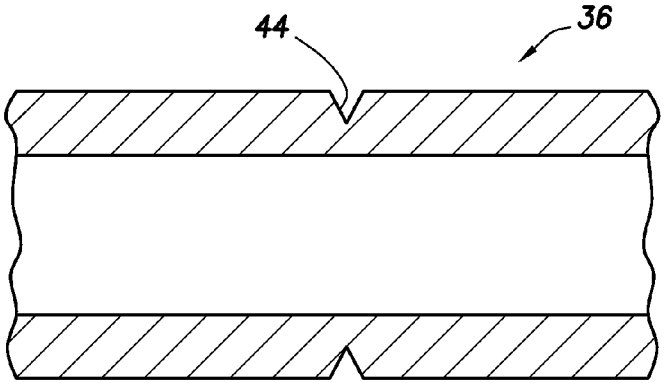

In FIG. 5, the conduit 36 is provided with a stress riser 44 in the form of a "V" shaped notch in an outer surface of the conduit. The stress riser 44 can be positioned adjacent the passage 28 so that, when the cement 16 cracks due to flow of fluid out of the passage, the conduit 36 will easily part at the stress riser, thereby opening the conduit. Preferably, in this configuration the conduit 36 (or at least a portion of the conduit adjacent the passage 28) would be made of a relatively brittle frangible material.

Figure 6:
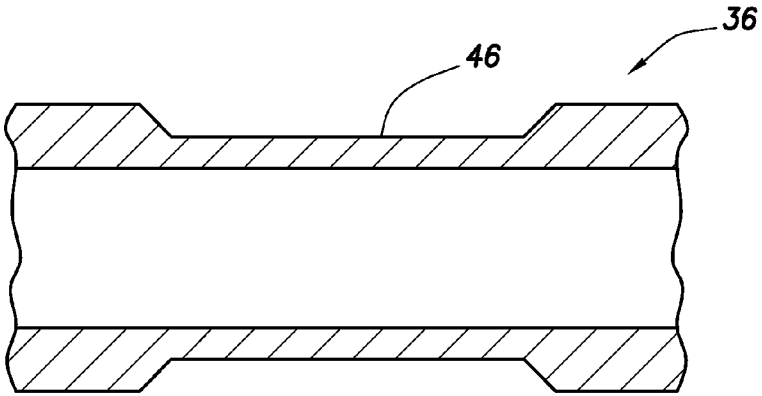
FIGS. 5-8 are representative side views of various configurations of the conduit.

In FIG. 6, the conduit 36 is weakened by providing a reduced outer diameter 46 on the outer surface of the conduit. The reduced outer diameter 46 can cause the conduit 36 to be more readily eroded, dissolved, fractured, etc. The reduced outer diameter 46 would preferably be positioned adjacent the passage 28.

Figure 7:
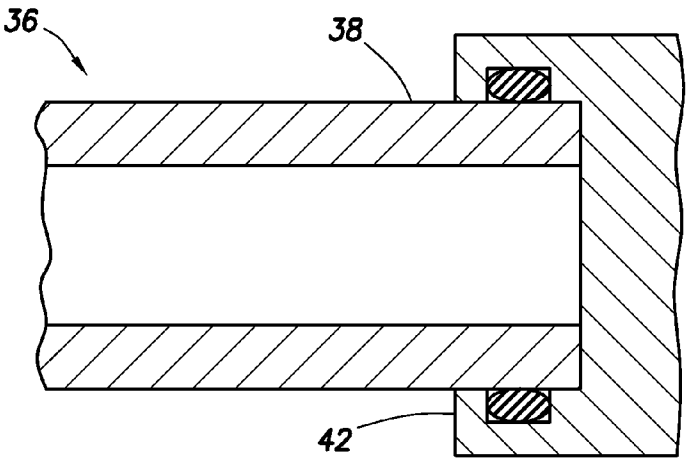

In FIG. 7, the conduit 36 is received in the sealed plug 42, thereby closing off the end 38 of the conduit. When the closure member 26 is displaced, the conduit 36 can be displaced to the left as viewed in FIG. 7, and/or the plug 42 can be displaced to the right as viewed in FIG. 7, so that the end 38 of the conduit is opened.

Figure 8:
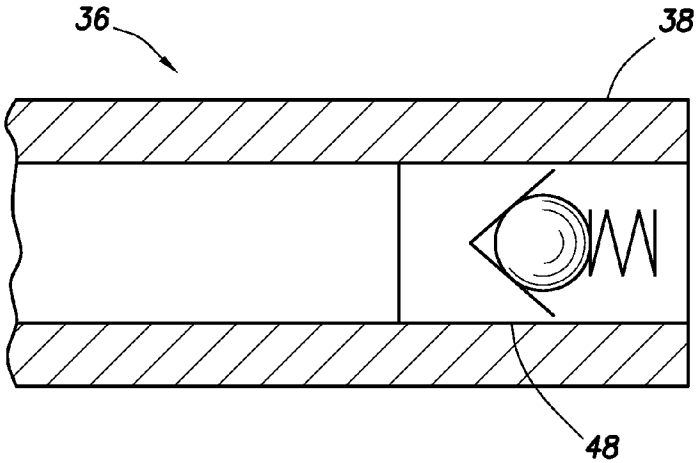

In FIG. 8, a relief valve 48 is provided in the end 38 of the conduit 36. The relief valve 48 permits pressure buildup in the conduit 36 (e.g., due to elevated temperature in the well) to be relieved. The relief valve 48 does not permit flow into the conduit end 38, but permits flow out of the conduit end if a pressure differential from the conduit 36 to the annulus 18 exceeds a predetermined level.

In any of the configurations of the conduit 36, the interior of the conduit can be pressure balanced relative to the annulus 18 (or other portion of the well), so that the conduit will not be collapsed by excessive external pressure, and/or burst by excessive internal pressure. Such pressure balancing could be implemented whether or not the relief valve 48 is also used to prevent excessive internal pressure.

Although in the configurations described above the conduit 36 is positioned outward relative to the passage 28, in other examples the conduit could be positioned inward relative to the passage, or could be otherwise positioned. The conduit 36 is not necessarily disposed in the annulus 18 or external to the flow control device 20.

It may now be fully appreciated that the above disclosure provides several advancements to the art. The conduit 36 can be conveniently opened in the well after the cement 16 has hardened, to thereby provide fluid communication with the well tool 22. Although the well tool 22 is described above as including the sensor 32 connected to the conduit 36, it will be appreciated that other types of well tools may be used in keeping with the scope of this disclosure.

Described above is a method of opening a conduit 36 cemented in a subterranean well. The method can include flowing a fluid 50 through a passage 28 in the well after the conduit 36 is cemented in the well, and the conduit 36 opening in response to the flow of the fluid 50 through the passage 28.

The conduit 36 opening can include the fluid 50 eroding the conduit 36.

The conduit 36 opening can include cement 16 fracturing adjacent the passage.

The conduit 36 may be connected to a well tool 22.

The well tool 22 may include a sensor 32.

The sensor 32 may comprise a pressure sensor.

The passage 28 may be formed in a flow control device 20.

The flow control device 20 may selectively permit and prevent flow through the passage 28.

The conduit 36 opening may include displacing the conduit 36 in response to displacement of a member 26 of the flow control device 20.

The conduit 36 may be connected to a well tool 22, the passage 28 may be formed in a flow control device 20, and the well tool 22 and flow control device 20 may be interconnected in a tubular string 12 cemented in a wellbore 14.

The conduit 36 opening may include establishing fluid communication between the conduit 36 and the passage 28.

The above disclosure also describes a well system 10. The well system 10 can include a flow control device 20 cemented in a wellbore 14, and a conduit 36 positioned adjacent a passage 28 of the flow control device 20. The conduit 36 opens in response to the passage 28 being opened.

The conduit 36 may be weakened adjacent the passage 28.

The conduit 36 may be pressure balanced with the passage 28.

The conduit 36 may have a stress riser 44 formed adjacent the passage 28.

The conduit 36 may open in further response to displacement of the conduit 36.

The conduit 36 may be cemented in the wellbore 14.

The conduit 36 may open in further response to erosion of the conduit 36.

The conduit 36 may open in further response to fracture of cement 16 adjacent the passage 28.

The conduit 36 may open in further response to displacement of a member 26 of the flow control device 20.

The conduit 36 may open in further response to flow through the passage 28.

The conduit 36 may open in further response to displacement of a plug 42 relative to the conduit 36.

The conduit 36 may be connected to a well tool 22, and the well tool 22 and flow control device 20 may be interconnected in a tubular string 12 cemented in the wellbore 14.

Fluid communication may be established between the conduit 36 and the passage 28 in response to flow through the passage 28.

It is to be understood that the various examples described above may be utilized in various orientations, such as inclined, inverted, horizontal, vertical, etc., and in various configurations, without departing from the principles of this disclosure. The embodiments illustrated in the drawings are depicted and described merely as examples of useful applications of the principles of the disclosure, which are not limited to any specific details of these embodiments.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of opening a conduit cemented in a subterranean well, the method comprising:

flowing a fluid through a passage in the well after the conduit is cemented in the well, wherein the conduit is spaced apart from the passage by cement which at least partially surrounds the conduit; and the conduit opening in response to the flow of the fluid through the passage, wherein the conduit connects a well tool in fluid communication with the passage in the well, and wherein the passage in the well connects the conduit in fluid communication with an internal flow passage of a tubular string.

2. The method of claim 1, wherein the conduit opening further comprises the fluid eroding the conduit.

3. The method of claim 1, wherein the conduit opening further comprises cement fracturing adjacent the passage.

4. The method of claim 1, wherein the well tool comprises a sensor.

5. The method of claim 4, wherein the sensor comprises a pressure sensor.

6. The method of claim 1, wherein the passage is formed in a flow control device.

7. The method of claim 6, wherein the flow control device selectively permits and prevents flow through the passage.

8. The method of claim 6, wherein the conduit opening further comprises opening the conduit in response to displacement of a member of the flow control device.

9. The method of claim 1, wherein the conduit is connected to a well tool, the passage is formed in a flow control device, and the well tool and flow control device are interconnected in the tubular string, wherein the tubular string is cemented in a wellbore.

10. The method of claim 1, wherein the conduit opening further comprises establishing fluid communication between the conduit and the passage.

11. A well system, comprising:

a flow control device cemented in a wellbore; and a conduit positioned adjacent a passage of the flow control device, wherein the conduit is spaced apart from the passage by cement which at least partially surrounds the conduit, whereby the conduit opens in response to the passage being opened, wherein the conduit connects a well tool in fluid communication with the passage of the flow control device, and wherein the passage of the flow control device connects the conduit in fluid communication with an internal flow passage of a tubular string.

12. The well system of claim 11, wherein the conduit is weakened adjacent the passage.

13. The well system of claim 11, wherein the conduit is pressure balanced with the passage.

14. The well system of claim 11, wherein the conduit has a stress riser formed adjacent the passage.

15. The well system of claim 11, wherein the conduit is cemented in the wellbore.

16. The well system of claim 11, wherein the conduit opens in further response to erosion of the conduit.

17. The well system of claim 11, wherein the conduit opens in further response to fracture of cement adjacent the passage.

18. The well system ofclaim 11, wherein the well tool comprises a sensor.

19. The well system of claim 18, wherein the sensor comprises a pressure sensor.

20. The well system of claim 11, wherein the flow control device selectively permits and prevents flow through the passage.

21. The well system of claim 11, wherein the conduit opens in further response to displacement of a member of the flow control device.

22. The well system of claim 11, wherein the conduit is connected to a well tool, and the well tool and flow control device are interconnected in the tubular string, wherein the tubular string is cemented in the wellbore.

23. The well system of claim 11, wherein fluid communication is established between the conduit and the passage in response to flow through the passage.

24. The well system of claim 11, wherein the conduit opens in further response to flow through the passage.

25. The well system of claim 11, wherein the conduit opens in further response to displacement of a plug relative to the conduit.

* * * * *